United States Patent [19]

Eheim et al.

[11] 3,970,064

[45] July 20, 1976

[54] RPM REGULATOR FOR FUEL INJECTION PUMPS

[75] Inventors: Franz Eheim, Stuttgart; Gerald Höfer, Weissach-Flacht; Karl Konrath, Ludwigsburg; Helmut Laufer, Stuttgart, all of Germany

[73] Assignee: Robert Bosch G.m.b.H., Stuttgart, Germany

[22] Filed: Jan. 3, 1975

[21] Appl. No.: 538,374

[30] Foreign Application Priority Data

Jan. 23, 1974 Germany ..... 2403082
Oct. 19, 1974 Germany ..... 2449859

[52] U.S. Cl. ..... 123/139 ST; 123/139 AZ; 123/140 R; 123/140 T; 123/179 L

[51] Int. Cl.[2] ..... F02M 39/00; F02D 1/04

[58] Field of Search ..... 123/139 ST, 139 AZ, 123/140 R, 140 J, 179 L

[56] References Cited

UNITED STATES PATENTS

| | | | |
|---|---|---|---|
| 3,185,141 | 5/1965 | Miracki et al. | 123/140 R |
| 3,577,968 | 5/0971 | Staudt | 123/140 J |
| 3,638,631 | 2/1972 | Eheim | 123/139 ST |
| 3,759,236 | 9/1973 | Staudt et al. | 123/140 J |
| 3,847,127 | 11/1974 | Staddt | 123/140 R |
| 3,884,206 | 5/1975 | Ritter | 123/140 R |

FOREIGN PATENTS OR APPLICATIONS

| | | | |
|---|---|---|---|
| 1,093,141 | 11/1960 | Germany | 123/139 ST |

*Primary Examiner*—Charles J. Myhre
*Assistant Examiner*—Paul Devinsky
*Attorney, Agent, or Firm*—Edwin E. Greigg

[57] ABSTRACT

An rpm regulator of a fuel injection pump for internal combustion engine includes a single-arm drag lever and an intermediate lever which are bent to define a space into which a compression spring extends. The stroke of the compression spring is limited in both directions by stops defined by the intermediate lever and the drag lever, respectively. The regulator also includes a control spring arrangement which engages one end of the drag lever, a fuel quantity setting member which engages one end of the intermediate lever and controls due to its movement the quantity of fuel delivered by the fuel pump and an rpm governor which exerts an rpm defendent force against the intermediate lever in opposition to the force of the control spring arrangement. With this regulator the pump can deliver an excess fuel quantity for starting purposes and an automatically reduced normal fuel injection quantity when the rpm increases. This result is accomplished without increasing the dimensions of the fuel pump.

12 Claims, 7 Drawing Figures

Fig.1
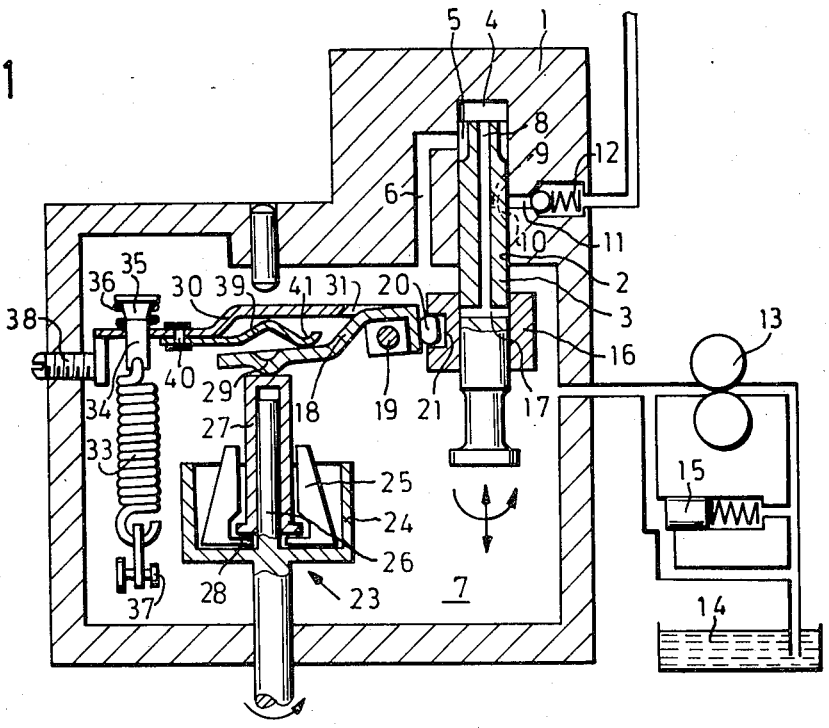
Fig.2
Fig.3
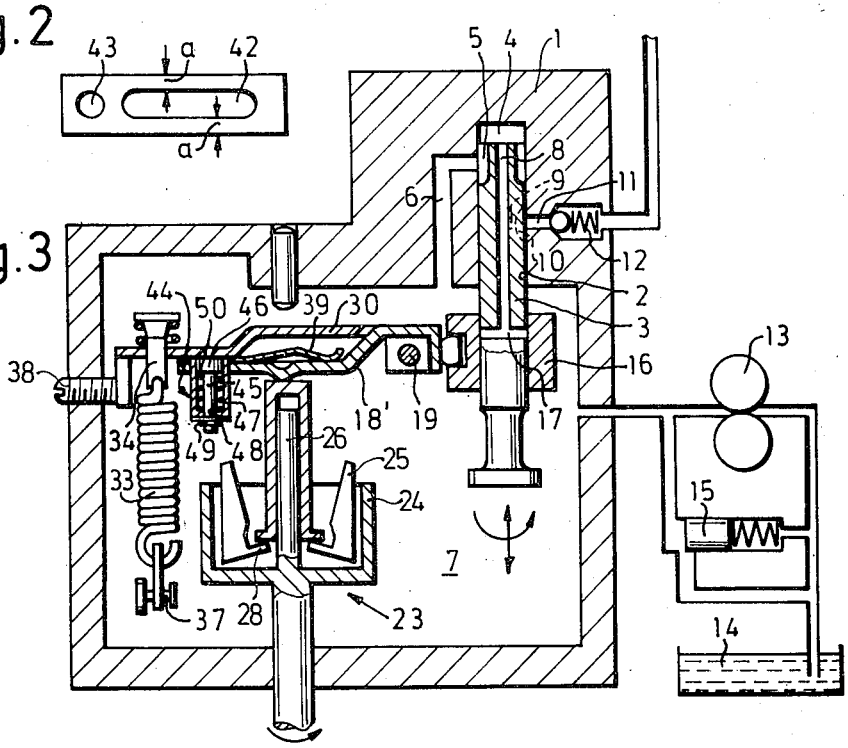

RPM REGULATOR FOR FUEL INJECTION PUMPS

BACKGROUND OF THE INVENTION

The present invention relates to an rpm regulator for fuel injection pumps used in internal combustion engines and more particularly to an rpm regulator for fuel injection pumps including an intermediate lever, an rpm governor, a main control spring, a second spring, and a stop. One end of the intermediate lever engages the fuel quantity setting member of the injection pump and is itself engaged by the rpm governor which acts with an rpm dependent force in opposition to an arbitrarily changeable force of the main control spring and also in opposition to the force of the second spring disposed in series with the first spring and deformable up to the stop.

A known serial injection pump of this type includes a centrifugal governor which operates in opposition to a main control spring. The main control spring, whose preload is changeable, sets a control rod. The centrifugal governor has a displaceable sleeve, the displacement of which is transmitted directly to the control lever; and, on the other hand, by a second lever rigidly connected to the first lever to a leaf spring consisting of several individual leaves.

The two ends of the leaf spring are held by an angled lever engaged by the main control spring and may be deformed on the angled lever up to an adjustable stop. Thus the leaf spring acts together with the main control spring to oppose the setting motion of the centrifugal governor so that, at the outset, the increasing governor setting forces lead to the deformation of the leaf spring up to its stop and only thereafter to a deformation of the main control spring. Hence, by means of this leaf spring, which in normal operation always engages its stop, one may obtain a starting excess fuel quantity which is automatically shut off after engine starts. In these installations, the control lever and the angled lever each have a separate pivotal axis.

One disadvantage of the apparatus described above is that it is expensive, especially in view of the method of fastening and the design of the leaf spring and its adjustment. Another disadvantage is that the control lever and the angled lever each have a separate axis which makes the apparatus not only expensive, but also wasteful of space. Still another disadvantage resides in the fact that the separate disposition of the levers requires large lever motions which require the centrifugal force governor to have a large working capacity.

OBJECTS AND SUMMARY OF THE INVENTION

It is, therefore, a principal object of the present invention to provide a fuel injection pump of the above described type in which the dimensions are kept as small as possible, especially in the operating region of the rpm regulator, and which achieves, in a simple manner, the provision of an excess fuel quantity, for starting, which is automatically reduced to the normal fuel injection quantity when the rpm increases.

It is a related object of the present invention to provide in a fuel injection pump of the type described in the previous object an adapting device or rather an idling controller which produces a reduction of the injected fuel quantity with increasing rpm in the sense of positive adaptation.

These and other objects are accomplished according to the present invention in that a single-arm drag lever is provided which cooperates with the intermediate lever, with one end of the drag lever being in engagement with the main control spring and with the drag lever and the intermediate lever defining a space within which there is disposed a compression spring whose stroke in both directions is limited by stops.

According to an advantageous embodiment of the present invention, the compression spring is embodied as a leaf spring fastened at one end to a drag lever or to the intermediate lever, and extending substantially along the levers and perpendicular to the operating direction of the centrifugal governor into a space formed by bending the levers, whereby this leaf spring may be deformed until the two levers touch each other.

As a result of this advantageous embodiment it is possible to keep the distance in the operating direction of the rpm regulator lever between the drag lever and the intermediate lever as small as possible. To add to this advantage, a soft spring may be located in the space defined by this distance for shutting off the starting excess fuel quantity when the rpm increases, so that, for example, in contrast to a helical compression spring which would be just as soft, it requires no additional guidance, which guidance would influence the control process. Hence, the friction associated with such a guided spring is also avoided. Furthermore, the leaf spring is made very simply as a punched-out part. The intermediate disposition of the spring between the drag lever and the intermediate lever limits, in a simple manner, the maximum deformation of the leaf spring which, together with the one-sided fastening of the levers represents a substantial space-saving advantage and makes it possible to provide a further adapting mechanism between both levers.

A further advantageous development of the present invention consists in that the leaf spring is reduced in cross section in its middle region. This cross sectional reduction is formed by a recess or opening. In this way, one obtains in a simple manner a soft leaf spring which still has the necessary strength. The size of the opening or recess may determine the spring constant of the leaf spring.

A further advantageous embodiment of the present invention consists in that an adapting box is disposed at the drag lever or at the intermediate lever in the region of the opening or recess of the leaf spring. This adapting box may serve as a movable stop between the drag lever and the intermediate lever. In this way and in an especially space spacing manner, one disposes an adapting mechanism which, during further increasing rpm produces a reduction of the injected fuel quantity in the sense of a positive adaptation or an adaptation in the sense of the control process.

The invention will be better understood and further objects and advantages will become apparent from the ensuing detailed specification of four preferred, although exemplary embodiments of the present invention taken in conjunction with drawing.

BRIEF DESCRIPTION OF THE DRAWING

In the drawing the invention is shown as a rpm regulator utilized with a distributor-type injection pump.

FIG. 1 is a cross-sectional front elevational view of a first exemplary embodiment of the present invention including a compression leaf spring;

FIG. 2 is a top view of a leaf spring according to the exemplary embodiment of FIG. 1;

FIG. 3 is a cross sectional front elevational view of a second exemplary embodiment of the present invention including an adapting box;

DESCRIPTION OF THE PREFERRED EMBODIMENTS

Figure 4:
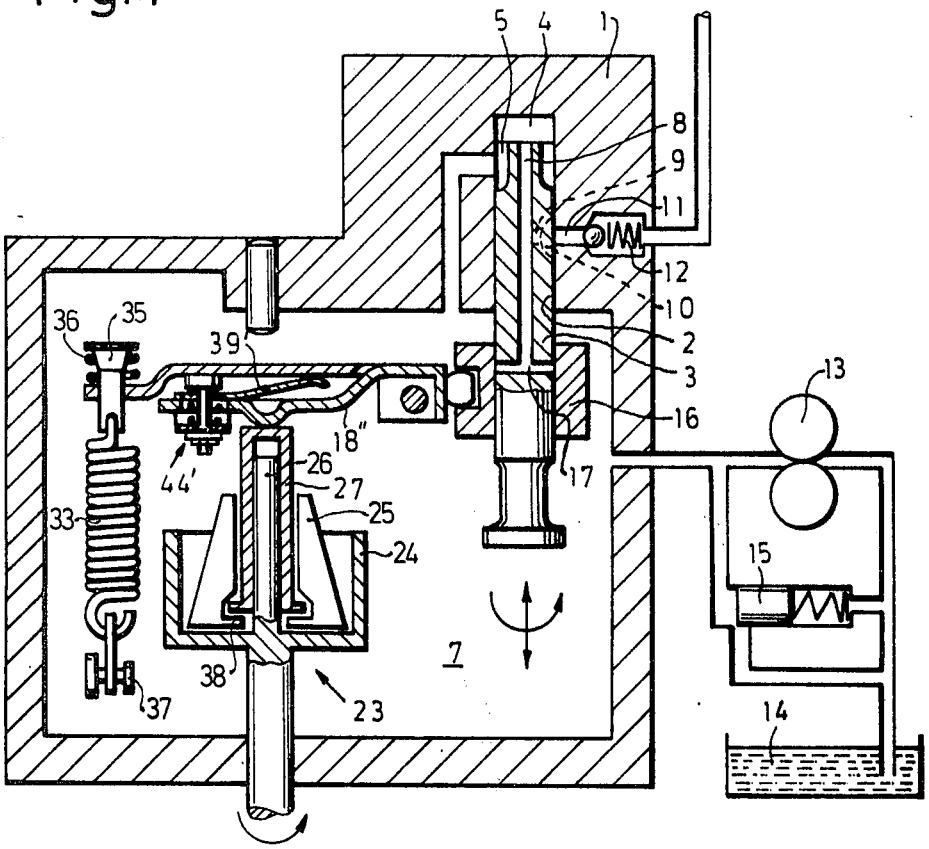
FIG. 4 is a third exemplary embodiment in which the adapting box and the leaf spring are fastened at the same lever.

A housing 1 of a fuel injection pump is provided with a cylindrical bore 2 in which a pump piston 3 is received. The pump piston 3 executes a simultaneous rotating and reciprocating motion in response to the action of drive means (not shown) and in opposition to a restoring spring (not shown). The bore 2 and pump piston 3 define a working chamber 4. The working chamber is provided with fuel by a longitudinal groove 5 formed in the outer surface of the pump piston 3 and by a channel 6 within the housing 1. The channel 6 provides a passage for the fuel from a suction chamber 7. Fuel delivery takes place while the pump piston 3 executes its suction stroke or while it is located in its bottom dead center position. As soon as the pressure stroke of the pump piston 3 has begun and after an appropriate rotation of the pump piston 3, the channel 6 is closed and the fuel located in the pump working chamber 4 is delivered into a longitudinal channel 8 extending within the pump piston 3. From this channel 8, the fuel is further delivered to a radial bore 9 and a longitudinal distributing groove 10 formed in the outer wall of the pump piston 3 and finally to one of a plurality of pressure lines 11. The number of pressure lines 11 is equal to the number of engine cylinders to be supplied with fuel and these lines are distributed about the circumference of the cylindrical bore 2. Each of the pressure lines 11 leads to a check valve 12 opening in the direction of fuel delivery and to an injection valve (not shown) disposed near the individual cylinders of the internal combustion engine.

The suction chamber 7 is supplied with fuel by a fuel pump 13 which takes fuel from a fuel storage container 14. The pressure in the suction chamber 7 is controlled in a known manner by a pressure control valve 15 disposed in parallel with the fuel supply pump 13.

Slidably located on the pump piston 3 is an annular slide member 16 which controls the aperture of a radial bore 17 formed in the pump piston 3 and communicating with the longitudinal channel 8. By effecting this control during the pressure stroke of the pump piston 3, the slide member 16 determines the end of fuel delivery or the fuel quantity delivered by the pump 13 to the pressure lines 11. After the aperture of the radial bore 17 has been opened, fuel flows back into the suction chamber 7.

The annular slide member 16 is displaced by an intermediate lever 18 pivotably mounted about a shaft 19 rigidly inserted into the housing 1. The lever 18 is provided with a head 20 which engages a recess 21 in the annular slide member 16. The other end of the intermediate lever 18 engages a centrifugal force governor 23 which is an rpm signal generator. The centrifugal force governor 23 is driven at pump piston rpm by gears (not shown). The centrifugal force governor 23 includes a carrier 24 holding flyweights 25, a shaft 26, and a sleeve 27. The sleeve 27 is slidably disposed with respect to the shaft 26, and its lower end is engaged by projections 28 of the flyweight 25 so that, when the flyweights move outwardly due to centrifugal forces, the sleeve 27 is axially displaced on the shaft 26 and, at the same time, it displaces the intermediate lever 18 and hence the annular slide member 16.

At the point where the sleeve 27 engages the intermediate lever 18, the lever 18 is provided with a hemispherical bulge 29 to achieve a frictionless and torque-free transmission of the setting motion of the centrifugal force governor.

A single-arm drag lever 30 is pivotably mounted on the same shaft 19 but independently of the intermediate lever 18. The lever 30 is symmetric with respect to the intermediate lever 18 and has a recess 31 into which the intermediate lever 18 extends, so that both levers can be pivoted independently of one another. The ends of both levers also overlap.

A main control spring 33 pivots at the end of the drag lever 30. This main control spring 33 is a tensile spring whose one end is fastened at a bolt 34 which penetrates the drag lever 30 in a bore therein and which is provided with a head 35 on the opposite side of the lever 30. An idling spring 36 may be located between the head 35 and the drag lever 30. The other end of the control spring 33 engages an arbitrarily settable lever 37. An adjustable full load stop 38 for the drag lever 30 is also provided.

Both the drag lever 30 and the intermediate lever 18 are bent so that, when the levers attach to one another, a space similar to a parallelogram is formed between them. In this position, both levers extend substantially parallel to one another. Extending into the intermediate space between the drag lever 30 and the intermediate lever 18 is a leaf spring 39 which, in the present example, is attached to the outer end of the drag lever 30 by a rivet 40. Beginning approximately at its center, the leaf spring 39 is bent in the direction of the centrifugal force governor 23 and it also has a rounded end 41 which lies on the intermediate lever 18. The leaf spring 39 urges the two levers 19 and 30 apart.

Figure 7:
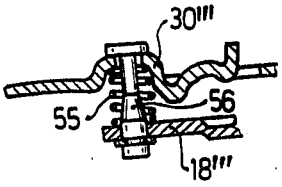
FIG. 7 is a fourth exemplary embodiment of the present invention in which the compression spring is a cylindrical spring.

Control of a fuel injection quantity as provided by the above described injection pump according to FIG. 1 occurs as follows:

Depending on the position of the annular slide member 16, the radial bore 17 and hence the relief connection from the working chamber 4 to the pump suction chamber 7 is opened sooner or later during the compression stroke or the delivery stroke of the pump piston 3 and hence the fuel delivery into the pressure lines 11 is interrupted. Thus, in the uppermost position of the annular slide member 16, the maximum or the entire fuel quantity delivered by the pump piston 3 is actually supplied to the pressure lines 11. The farther down the annular slide member 16 is moved, the sooner the radial bore 17 is opened and fuel delivery is interrupted. In the starting position shown in FIG. 1, the drag lever 30 lies against the full load stop 38, whereas the intermediate lever 18 is pressed against the sleeve 27 of the centrifugal force governor 23 by the leaf spring 39. The excursion of the intermediate lever 18 also moves the control slide member 16 into its upper position corresponding to the delivery of an excess fuel quantity. After the internal combustion engine has started up, the increasing rpm causes the fly weights 25 to move outwardly, so that the governor sleeve 27 is moved up and, for increasing rpm, the intermediate lever 18 is pivoted against the force of the leaf spring 39 up to its attachment at the drag lever 30. At this point, the excess fuel quantity is reduced to the normal full-load quantity. During a further rpm increase, and depending on the precompression of the main control spring 33, the intermediate lever 18 and the drag lever 30 are pivoted together, at the very latest when the nominal control rpm is reached, and hence the annular slide member 16 is moved farther down. Thus, in normal operation, the drag lever 30 and the intermediate lever 18 always lie against one another. However, according to the invention, the leaf spring 39 can also serve as the idling spring. In such a case, one would dispense with the spring 36 and employ a spring 55, as shown in FIG. 7, as the compression spring instead of the spring 39. In a partial region of its stroke the spring 55 would act as a starting spring and in a further region as an idling spring.

Of course, the leaf spring 39 can also be fastened in analogous fashion to the intermediate lever 18 and can be supported opposite to the drag lever 30. In order to obtain a soft but dimensionally stable leaf spring, it is advantageous, as may be seen in FIG. 2, to provide it with an opening 42 and to make it somewhat wider to accommodate this opening. The width of the bridges a and the thickness of the leaf determines the rigidity of the spring. The leaf spring may be provided with one or several holes 43 for fastening it to one of the levers.

FIG. 3 shows substantially the same apparatus but, in this case, an adapting box 44 is provided on the intermediate lever 18'. In this case, the intermediate lever 18' and the drag lever 30 are shown in the position they occupy after the excess starting fuel quantity has been shut off.

In the exemplary embodiment of FIG. 3, the adapting box 44 consists of a cap 47, located perpendicularly on the intermediate lever 18' and it is open in the direction of the drag lever 30. It contains a bolt 45 guided in a bore 48 formed in the bottom of the cap 47. The bolt 45 extends outside of the cap 47 and has a stop 49 in the form of a safety ring with a disk. The other end of the bolt 45 nearest the drag lever 30 is provided with a head 46 serving as a stop for a compression spring 50 clamped between the head 46 and the bottom of the cap 47. Discs may be interposed at the stop 49 for changing the pre-compression of the compression spring 50.

When the levers 30 and 18' are not pressed together, the head 46 extends beyond the intermediate lever 18'. For this purpose the opening 42 in the leaf spring 39 is so dimensioned that the head 46 may move through it without hindrance. Hence at first, the head 46 serves as a stop between the drag lever 30 and the intermediate lever 18'. Only when the rpm is increasing and the setting forces of the centrifugal force governor 23 are increasing, is the bolt gradually displaced against the force of the compression spring 50 until the drag lever 30 and the intermediate lever 18' engage flatly against each other. This displacement simultaneously causes a displacement of the annular slide member 16 and a reduction of the delivered fuel injection quantity. Only when the nominal control rpm has been reached is the force of the main control spring 33 overcome by the force of the governor sleeve 27 and the annular slide member 16 is displaced further downwardly in the direction of a minimum fuel supply quantity or its complete interruption through the simultaneous movement of the levers 18' and 30.

Hence, the provision of an adapting box achieves a positive adaptation, i.e., an adaptation in the sense of the control process, which means that, for example, the normally parallel full-load characteristic curve is inclined somewhat, beginning at a certain rpm determined by the spring characteristics of the compression spring 50 and on the setting path of the bolt 45. When the starting spring 39 is embodied with an opening 42 it permits the provision, in a very favorable manner and without requiring substantially more space in the direction of the centrifugal force governor, of both an excess full starting device as well as an adapting device.

FIG. 4 shows a further exemplary embodiment of the present invention located in an injection pump which operates in the same manner as those according to the exemplary embodiments of FIGS. 1 and 3. In this case, the leaf spring 39' and the adapting box 44' are both fastened on the intermediate lever 18''. The adapting box 44' is considerably simplified by being embodied merely as a bracket or a U-shaped bent sheet metal part 52 which is riveted to the intermediate lever 18'' together with the leaf spring 39'.

Figure 5:
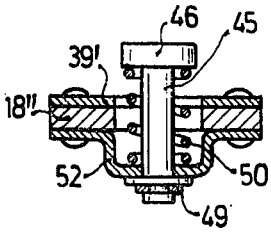
FIG. 5 is a cross-sectional view at the fastening location of the adapting box according to the exemplary embodiment of FIG. 4.
Figure 6:
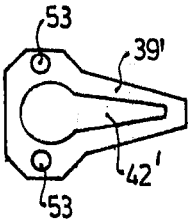
FIG. 6 is a top view of the leaf spring according to the exemplary embodiment of FIG. 4.

FIG. 5 is an enlarged showing of this adapting box and FIG. 6 shows the form of the leaf spring 39' which, in this case, has a pointed, cone-shaped end and two fastening holes 53 at the other, broad end. The opening 42' in the leaf spring 39' is adapted to the measurements of the bolt 45 and its head 46. In this exemplary embodiment, the leaf spring 39' has a broad fastening region which guarantees in a favorable manner a stable fastening of the leaf spring 39'.

The leaf spring shown in the above exemplary embodiment may, in principle, be made of metal and in one layer. However in an especially favorable manner, the leaf spring may also be bimetallic. Due to the different expansions at different temperatures, the pre-tension or the spring constant of the leaf spring may be changed as a function of temperature. It is advantageous that the leaf spring is so designed that when it is cold it has the highest rigidity or deformation in the sense of pushing the drag lever and the intermediate lever apart. As the temperature increases, the rigidity or the deformation decreases. In this process, the leaf spring is heated by the fuel in the interior of the injection pump. Therefore, when the leaf spring is cold, a larger force must be exerted by the sleeve of the rpm signal generator, i.e., a larger rpm is required, to shut off the excess starting fuel quantity. Thus, by the appropriate choice of the material and the dimensions of the leaf spring, one is given the ability to control the excess starting fuel quantity in a temperature-dependent manner and, further, the possibility to shut off the excess quantity in advance when the injection pump has reached its operational temperature. This brings the additional advantage of a reduction of the toxic exhaust gases when the associated internal combustion engine is started up.

When the spring also serves as the idling spring, it is possible that non-temperature dependent rigidity remains for the control of the idling operation.

The exemplary embodiment shown in FIG. 7 which is provided in an injection pump similar to that shown above, uses a helical spring 55 instead of a leaf spring. This spring 55 may have a soft characteristic and, in the first region of its stroke, serves as a starting spring and in its upper, stiffer region as an idling spring. The spring 55 is guided by a bolt 56 which, at the same time, determines the maximum distance between the levers 30''' and 18'''. When the engine is loaded, the spring 55 may move the intermediate lever 18''' beyond the full load position into the starting position which insures that the engine will "rev" up.

What is claimed is:

1. In an rpm regulator for use with a fuel injection pump associated with an internal combustion engine, said regulator including a housing, an intermediate lever, a pivot shaft which pivotably mounts the intermediate lever to the housing, a stop mounted to the housing, a main control spring, means mounting one end of the main control spring to the housing, said mounting means including means for arbitrarily changing the force exerted by the main control spring, a further spring mounted in series with the main control spring and being deformable up to the stop, and an rpm governor mounted to the housing which engages the intermediate lever and exerts an rpm dependent force in opposition to the forces of the main control spring and the further spring, the improvement comprising:

a. a single-arm drag lever mounted at one end for pivotal movement to the pivot shaft of the intermediate lever and in engagement at its other end with the main control spring, the further spring and the stop, said drag lever cooperating in its movement with the intermediate lever; and b. a compression spring mounted between the intermediate lever and said drag lever, the stroke of said compression spring being limited in both directions of force application by stops defined by the intermediate lever and said drag lever, respectively, said compression spring being embodied as a temperature dependent leaf spring having a pre-load which is greater in cold conditions and an opening formed in its middle region which produces a reduced cross section in this region.

2. The rpm regulator as defined in claim 1, wherein:

i. said compression spring is embodied as a leaf spring which is fastened at one end to said drag lever;

ii. the intermediate lever and said drag lever have bent configurations;

iii. said compression spring extends from its fastened end into a space defined by the bent configuration of both the intermediate lever and said drag lever; and iv. The extension of said compression spring into said space is substantially along the length of the intermediate lever and said drag lever and perpendicular to the operating direction of the centrifugal governor, whereby said compression spring may be deformed to such an extent that the intermediate lever and said drag lever touch each other.

3. The rpm regulator as defined in claim 1, wherein:

i. said compression spring is embodied as a leaf spring which is fastened at one end to the intermediate lever;

ii. the intermediate lever and said drag lever have bent configurations;

iii. said compression spring extends from its fastened end into a space defined by the bent configuration of both the intermediate lever and said drag lever; and iv. the extension of said compression spring into said space is substantially along the length of the intermediate lever and said drag lever and perpendicular to the operating direction of the centrifugal governor, whereby said compression spring may be deformed to such an extent that the intermediate lever and said drag lever touch each other.

4. The rpm regulator as defined in claim 1, wherein said leaf spring has a bent end which serves as an adjustment for one of the levers.

5. The rpm regulator as defined in claim 4, further comprising:

c. an adapting box mounted to said drag lever in the region of the opening in said leaf spring, said adapting box serving as a movable stop between the intermediate lever and said drag lever.

6. The rpm regulator as defined in claim 4, further comprising:

c. an adapting box mounted to the intermediate lever in the region of the opening in said leaf spring, said adapting box serving as a movable stop between the intermediate lever and said drag lever.

7. The rpm regulator as defined in claim 1, wherein said compression spring is embodied as a bi-metallic leaf spring.

8. The rpm regulator as defined in claim 1, further comprising a bolt which passes through the intermediate lever and said drag lever, wherein said compression spring is embodied as a cylindrical spring concentric with said bolt and engageable with the intermediate lever and said drag lever to determine their maximum separation and hence the largest stroke of said compression spring.

9. The rpm regulator as defined in claim 1, wherein said compression spring serves both as an idling spring and as a starting spring.

10. In an rpm regulator for use with a fuel injection pump associated with an internal combustion engine, said regulator including a housing, an intermediate lever, a pivot shaft which pivotably mounts the intermediate lever to the housing, a stop mounted to the housing, a main control spring, means mounting one end of the main control spring to the housing, said mounting means including means for arbitrarily changing the force exerted by the main control spring, a further spring mounted in series with the main control spring and being deformable up to the stop, and an rpm governor mounted to the housing which engages the intermediate lever and exerts an rpm dependent force in opposition to the forces of the main control spring and the further spring, the improvement comprising:

a. a single-arm drag lever mounted at one end for pivotal movement to the pivot shaft of the intermediate lever and in engagement at its other end with the main control spring, the further spring and the stop, said drag lever cooperating in its movement with the intermediate lever;

b. a compression spring mounted between the intermediate lever and said drag lever, the stroke of said compression spring being limited in both directions of force application by stops defined by the intermediate lever and said drag lever, respectively; and c. an adapting box mounted to the intermediate lever in the region of the opening in said leaf spring, said adapting box serving as a movable stop between the intermediate lever and said drag lever, said adapting box including:

i. a bolt, one end of which is provided with a stop, serving as a first stop, and the other end of which passes through a box provided in the intermediate lever;

ii. means for fastening the bolt to the intermediate lever;

iii. a pre-loaded further compression spring mounted between the stop and one side of said fastening means; and iv. a second stop mounted to the bolt on the other side of said fastening means, wherein the preload in said further compression spring can be fixed by the position of the second stop.

11. The rpm regulator as defined in claim 10, wherein said fastening means includes a cup-shaped housing and means for rigidly connecting the cup-shaped housing to the intermediate lever, and wherein the bolt and further compression spring are located within the cup-shaped housing.

12. The rpm regulator as defined in claim 10, wherein said fastening means includes a bent sheet-metal part having a U-shaped cross section and means for rigidly connecting the sheet-metal part and said leaf spring to the intermediate lever and wherein the bolt and further compression spring are located in the sheet-metal part.

* * * * *